US005556084A

United States Patent [19]

Hodges

[11] Patent Number: 5,556,084

[45] Date of Patent: Sep. 17, 1996

[54] UNIVERSAL TRANSMISSION STAND

[76] Inventor: Douglas Hodges, 672 W. 12th St., San Pedro, Calif. 90731

[21] Appl. No.: 392,198

[22] Filed: Feb. 22, 1995

[51] Int. Cl.[6] ..... B66F 3/00

[52] U.S. Cl. ..... 269/60; 269/17; 269/88; 269/287; 269/909; 254/DIG. 16

[58] Field of Search ..... 254/100, 133, 254/134, DIG. 16, 8 B; 269/287, 88, 60, 17, 909

[56] References Cited

U.S. PATENT DOCUMENTS

| | | | |
|---|---|---|---|
| 2,748,459 | 6/1956 | Orr | 254/134 |
| 4,549,722 | 10/1985 | Gagliano | 254/DIG. 16 |
| 4,560,151 | 12/1985 | Grundy | 254/DIG. 16 |
| 5,141,211 | 8/1992 | Adams | 269/17 |
| 5,160,125 | 11/1992 | Jenkins | 269/17 |
| 5,259,602 | 11/1993 | Rogos | 269/17 |

*Primary Examiner*—Robert C. Watson
*Attorney, Agent, or Firm*—Roger A. Marrs

[57] ABSTRACT

A stand is disclosed herein for supporting one of a variety of automotive components, such as a transmission, which includes a base having four upright posts terminating in connection with a support plate. The center of the plate is provided with a mounting opening for accommodating one of a variety of adaptors for holding, supporting and stabilizing a transmission during servicing. A selected adaptor may be a spacer, a shaft stabilizer, or a movable plunger and support bracket therefor. A height and width adjustment fixture is carried on the support plate for lateral and vertical extension to accommodate transmissions of different size.

3 Claims, 1 Drawing Sheet

UNIVERSAL TRANSMISSION STAND

BACKGROUND OF THE INVENTION

1. Field of the Invention

The present invention relates to the field of automobile component stands, and more particularly to a novel universal stand for supporting and stabilizing a selected transmission from a variety so that service and maintenance procedures can be performed on the transmission with speed, safety single-handed setup.

2. Brief Description of the Prior Art

In the past, it has been the conventional practice to service automotive components, such as transmissions, by using a multiplicity of stands which are specially constructed to hold or support a specific transmission. Inasmuch as there are many different models and types of transmissions requiring service and maintenance, the garage and mechanic must acquire a great number of stands in order to perform the work. In some instances, a single stand may accommodate one or two different transmissions; however, in these instances, the transmission is often unstable and may tilt or topple from the stand during the maintenance procedure. Also, generally more than one person is needed to set up the stand and to mount the transmission properly so that it may be worked upon.

Therefore, a long-standing need has existed to provide a novel work stand for an automotive component, such as a transmission, which will not only accommodate a variety of different transmissions but which will support and stabilize a selected transmission so that it may be operated or worked upon by a maintenance person. Such a stand should include a universal base upon which a variety of adaptors can be accommodated either singularly or in combination so as to support a selected transmission from the variety.

SUMMARY OF THE INVENTION

Accordingly, the above problems and difficulties are avoided by the present invention which provides a novel universal automotive component support stand which includes a base means supporting a selected transmission from a variety by means of an elevated support plate having a central opening. The opening accommodates one or more of a selected number of adaptors which will engagingly support the transmission in a vertical position. One such adaptor may merely be a spacer which fits on the opening of the support plate through which the driveshaft of the transmission may be passed. Another adaptor may be a shaft stabilizing sleeve which is supported on the plate through the opening and extends in a downwardly depending orientation through which the driveshaft may be inserted for stabilization and load-bearing purposes. Still another adaptor resides in a movable plunger and support bracket which bears against the end of the shaft extending from the transmission to support the transmission and to augment the transmission of applied load through a V-bracket into the support plate and the base. A height and width adjustment fixture is carried on the side of the support plate and includes a bell housing adaptor movable in a lateral manner from the side of the support plate so as to adjust for width of transmission, and which further includes an extension plate which can be varied in height to accommodate support height for the transmission.

Therefore, it is among the primary objects of the present invention to provide a novel universal automotive component support stand which is capable of providing stability, reliance and versatility in supporting a variety of transmissions or other components. Preferably, the stand is lightweight and durable, utilizing all metal parts which are either black oxide dipped or powder coated.

Another object of the present invention is to provide a self-sufficient one-piece universal stand or tool which is easy to use by a single person in a short period of time such as two minutes.

Yet another object of the present invention is to provide a novel transmission support stand which will accommodate the transmissions of most RWD vehicles and which is safe, quick, simple and reliable.

A further object of the invention resides in providing a transmission stand which is convenient to use, has ease of application and results in time-saving labor.

Still a further object of the present invention is to provide a novel transmission support stand for accommodating a selected one of a multiplicity of transmissions of different size and shapes and which includes a plurality of adaptors which may be used singularly or in combination so that various applied loads while being supported will be transferred or distributed to a base and to the supporting floor.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the accompanying drawings in which:

DESCRIPTION OF THE PREFERRED EMBODIMENT

Figure 1:
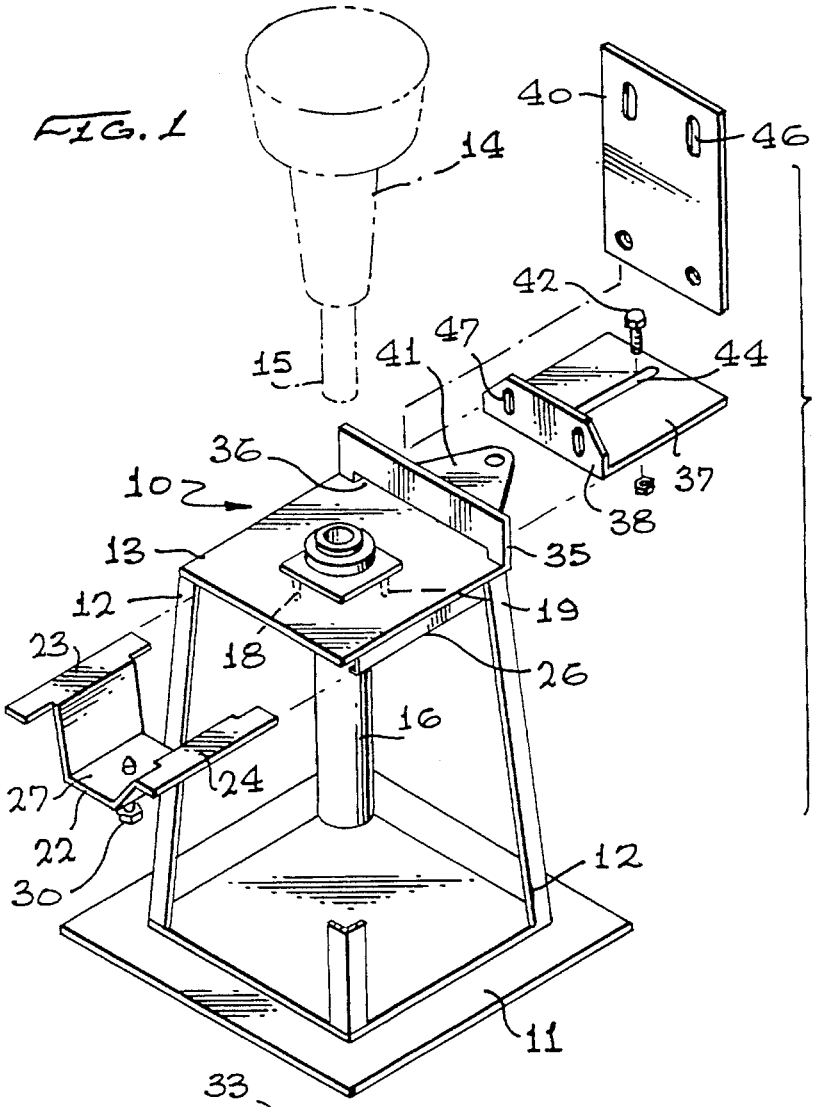
FIG. 1 is a front elevational view of the novel universal stand incorporating the present invention and illustrating utilization of adaptors to accommodate specific transmissions.
Figure 2:
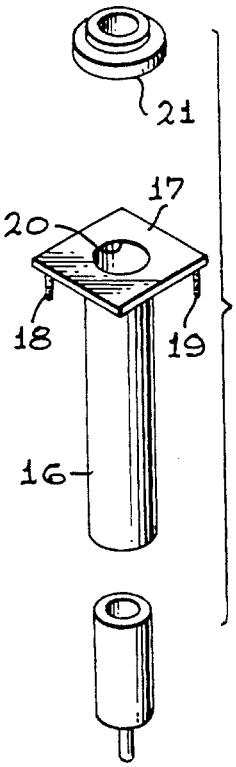
FIG. 2 is a perspective exploded view showing adaptors for use on the stand illustrated in FIG. 1.

Referring to FIG. 1, the novel universal automobile component stand of the present invention is indicated in the general direction of arrow 10, which includes a base 11 resting on the floor of a garage or the like. The base includes four posts or stanchions, such as identified by numeral 12, which extend upwardly to terminate in attachment with the underside of a support plate 13. The support plate 13 is formed with a central opening into which selected adaptors may be placed in order to support an engine or automotive component, such as the transmission shown in broken lines by numeral 14. In some instances, the transmission housing is directly supported on the plate 13 and in other instances, the driveshaft 15 extends downwardly from the housing 14. As illustrated, the support plate includes a sleeve 16 that downwardly depends from the underside of the plate 13 when passed through the central opening. The upper end of the sleeve 16 includes a mounting flange 17 which has two downwardly depending pins 18 and 19 which pass through openings on opposite sides of the central opening on plate 13. The transmission 14 may be lowered so that the shaft 15 passes into the hollow bore 20 of the sleeve, such as is indicated in FIG. 2. For some selected transmissions, a spacer 21 is employed which formfits to the housing 14 or a component thereof when the shaft 15 is inserted through the bore 20 of sleeve 16. Thus, the transmission is supported and stabilized on the support plate and any load distribution is via the support plate and stanchions or posts 12 into the base 11.

Figure 3:
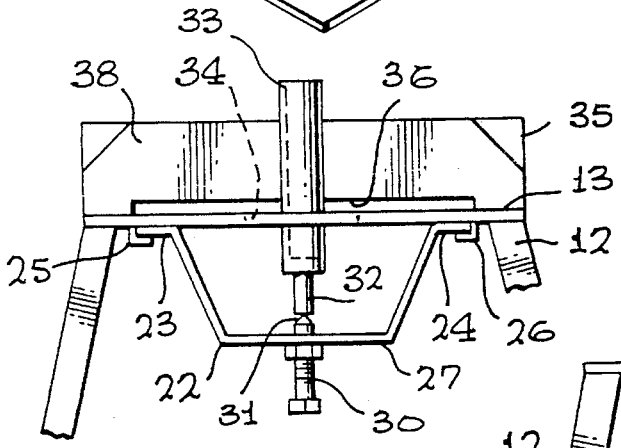
FIG. 3 is a fragmentary side elevational view of the stand shown in FIG. 1 with a movable plunger and V-shaped bracket adaptor system.

Referring now in detail to FIGS. 1, 2 and 3, another adaptor is illustrated for supporting a different transmission. Such adaptor includes a V-bracket 22 which includes side flanges 23 and 24 that are slidably received within guides 25 and 26 located on the underside of plate 13 in fixed parallel spaced relationship. The bracket 22 includes a bolt affixed to a portion 27 where the bolt is indicated by numeral 30 and the nut threadably engaged with the shank of the bolt is indicated by numeral 28. The bolt includes a tapered end terminating in a point 31 which is engagement with a conical depression located in the extreme end or face of a spindle 32. The spindle is carried on the underside of a plunger 33 and the plunger passes through the central opening in plate 13 and such an opening is indicated in broken lines by numeral 34. In this instance, the adaptor sleeve 16 and the spacer 21 are not employed and may be placed on a bench or shelf preparatory for mounting another and different transmission.

It can be seen that by using the adaptor bracket 22 and the bolt 30, the position of plunger 32 and the transmission itself can be adjusted with respect to height. The bolt 30 may be moved by employing a wrench to vertically move the transmission. It can also be seen that the load distribution is via the bracket 22 into the support plate 13 and then into the stanchions or posts 12 and base 11.

Figure 4:
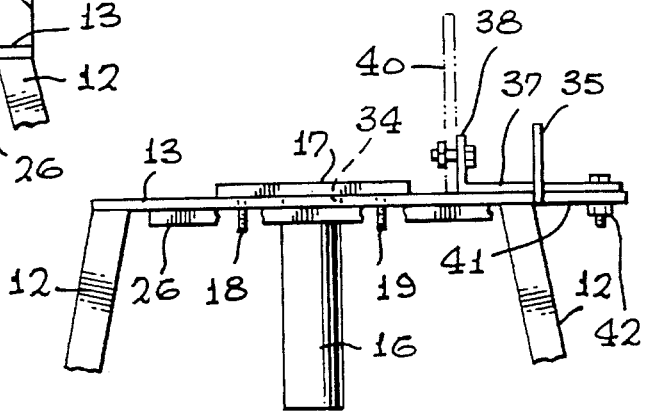
FIG. 4 is a side elevational view, in fragmentation, of the stand shown in FIG. 1 with a lateral height and width adjustment bracket.

Referring now in detail to FIGS. 1, 3 and 4, means are provided on the stand for adjusting to the height and width of the transmission 14 by including a guide plate 35 on one side of the support plate 13 which includes a slot 36 permitting an adaptor plate 37 to slide therethrough. The plate 37 includes a flanged end 38 which is disposed between the guide flange 35 and the central opening of the support plate.

As seen more clearly in FIGS. 1 and 4, the support plate 13 includes a triangular lateral portion 41 that outwardly projects in a cantilevered manner from one side of the support plate. The adaptor plate 37 moves across the top of the support plate and the portion 41 through the slot 36. Attached to the flange 38, there is an extension plate 40 which is adjustably coupled to the adaptor plate by bolts, such as shown in FIG. 4. The adaptor plate 37 is guided and detachably connected to the portion 41 by means of a nut and bolt arrangement, identified by numeral 42. Numeral 43 identifies the bolt and nut combination adjustably supporting the extension plate 40 to the flange 38. It can be seen more clearly in FIG. 1 that the adaptor 37 includes an elongated slot 44 through which the bolt 42 is passed so that the adaptor 37 may be moved across the support plate 13 when the bolt 42 is loosened, followed by tightening of the bolt to maintain the adaptor plate 37 in a preferred location. Thus, width is adjusted by moving the plate 37 to and from the guide plate 35 while height can be adjusted by the extension plate 40 and its adjustment through the elongated slots through which bolts 43 pass. Such elongated slots are indicated by numeral 46 on the plate 40 and elongated slots 47 are shown on the plate 38.

In view of the foregoing, it can be seen that the universal stand 10 of the present invention provides a support plate 13 which evenly distributes applied loads to the base 11 via the stanchions or posts 12. A variety of transmissions can be serviced by the inventive stand through the use of the various adaptors. For one transmission, as an example, spacer 21 may be used all by itself by placing a small ring 48 into the central opening in formfitting fashion and the shaft 15 or other shaft on the transmission can pass through the bore of the spacer. If desired, the spacer 21 may be reversed as shown in FIG. 1, and the spacer can be used by itself or in conjunction with the sleeve 16. The width and height adjustment means can be employed for particular transmissions by sliding the adaptor plate 37 outwardly from the guide plate 35 and height can be adjusted by placing one of several extension plates 40 onto the mounting flange 8. The upper end of the extension plate will bear against a location point on the transmission for support, and in this event, additional load forces will be distributed through the extension plate, the adaptor plate 37 and into the support plate 13. Also, the transmission can be raised or lowered through the use of the plunger 33 in connection with the height adjustment means 30. The load distribution is through the V-bracket 22 into the support plate.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A universal transmission support stand comprising:

a base;

a support plate having edge marginal regions and a central opening;

elongated posts connecting said base with said support plate whereby said support is elevated over said base in fixed spaced relationship therewith;

a plurality of adaptors;

a selected one of said adaptors detachably carried on said support plate and seated in said central opening so as to accept load forces for distribution via said support plate to said base;

said plurality of adaptors includes an annular spacer having a pair of concentric integral rings, each ring being of a different diameter and with a common coextensive bore.

2. A universal transmission support stand comprising:

a base;

a support plate having edge marginal regions and a central opening;

elongated posts connecting said base with said support plate whereby said support is elevated over said base in fixed spaced relationship therewith;

a plurality of adaptors;

a selected one of said adaptors detachably carried on said support plate and seated in said central opening so as to accept load forces for distribution via said support plate to said base;

said plurality of adaptors includes an elongated sleeve having an open-ended bore; and a mounting flange affixed to one end of said sleeve detachably connectable to said support plate with said sleeve occupying said central opening and downwardly depending from said support plate.

3. A universal transmission support stand comprising:

a base;

a support plate having edge marginal regions and a central opening;

elongated posts connecting said base with said support plate whereby said support is elevated over said base in fixed spaced relationship therewith;

a plurality of adaptors;

a selected one of said adaptors detachably carried on said support plate and seated in said central opening so as to accept load forces for distribution via said support plate to said base;

said plurality of adaptors includes said support plate having a top surface and an undersurface;

a pair of spaced-apart, parallel rails fixed to said support plate undersurface and separated by said central opening;

a bracket slidably carried between and on said pair of rails;

an elongated plunger occupying said central opening and downwardly depending from said support plate undersurface, said plunger having an open receptacle at one end exposed from said support plate top surface and a conical recess on its opposie end; and an adjustment means movably carried on said bracket in engagement with said plunger conical recess for advancing and retracting said plunger through said central opening.

* * * * *